US011658449B2

(12) United States Patent
Holzapfel et al.

(10) Patent No.: US 11,658,449 B2
(45) Date of Patent: May 23, 2023

(54) SLIPRING WITH WEAR MONITORING

(71) Applicant: SCHLEIFRING GMBH, Fürstenfeldbruck (DE)

(72) Inventors: Christian Holzapfel, Fürstenfeldbruck (DE); Matthias Hermann, Dachau (DE); Holger Steffens, Schwabmünchen (DE); Holger Häffner, Schwabmünchen (DE)

(73) Assignee: SCHLEIFRING GmbH, Fürstenfeldbruck (DE)

( * ) Notice: Subject to any disclaimer, the term of this patent is extended or adjusted under 35 U.S.C. 154(b) by 192 days.

(21) Appl. No.: 15/482,596

(22) Filed: Apr. 7, 2017

(65) Prior Publication Data

US 2017/0214202 A1 Jul. 27, 2017

Related U.S. Application Data

(63) Continuation of application No. PCT/EP2015/073764, filed on Oct. 14, 2015.

(51) Int. Cl.

| | |
|---|---|
| ***H01R 39/58*** | (2006.01) |
| ***H01R 39/22*** | (2006.01) |
| ***H01R 39/08*** | (2006.01) |
| ***H01R 39/56*** | (2006.01) |
| ***H01R 43/12*** | (2006.01) |

(52) U.S. Cl.

CPC ..... *H01R 39/58* (2013.01); *H01R 39/08* (2013.01); *H01R 39/22* (2013.01); *H01R 39/56* (2013.01); *H01R 43/12* (2013.01)

(58) Field of Classification Search

CPC ..... H01R 39/58; H01R 39/08; H02K 13/003; H02K 31/00; H02K 31/02

USPC ..... 310/228, 232

See application file for complete search history.

(56) References Cited

U.S. PATENT DOCUMENTS 1,703,719 A * 2/1929 Bryant ..... H04J 3/04 178/17.5
2,949,592 A * 8/1960 Smiley ..... H01F 29/06 29/597
3,609,427 A 9/1971 Lautner et al.
(Continued)

FOREIGN PATENT DOCUMENTS

DE 3434627 A * 6/1985
DE 102008001702 A1 11/2009
(Continued)

OTHER PUBLICATIONS

Gesemann (DE 3434627 A) English Translation (Year: 1985).*
Xaver (FR 2691848 A1) English Translation (Year: 1993).*
Bayer (DE 102012218095 A1) English Translation (Year: 2014).*

*Primary Examiner* — Tulsidas C Patel
*Assistant Examiner* — Robert E Mates
(74) *Attorney, Agent, or Firm* — Quarles & Brady LLP; Yakov S. Sidorin

(57) ABSTRACT

A slipring with at least one slip ring module having at least one sliding track, and at least one wear indication track. A wear indication circuit is connected to the at least one wear indication track for monitoring electrical properties of the wear indication track and signaling an abnormal slipring condition. A wear indication track may be exposed to higher load, higher rotation speed, higher brush pressure force, or other lifetime-reducing influence as compared to a normal sliding track.

9 Claims, 5 Drawing Sheets

(56) References Cited

U.S. PATENT DOCUMENTS

| | | | | | |
|---|---|---|---|---|---|
| 3,609,429 | A * | 9/1971 | Thompson | G01R 31/343 | 310/246 |
| 4,316,186 | A * | 2/1982 | Purdy | H02K 5/14 | 310/249 |
| 6,349,458 | B1 * | 2/2002 | Al-Rawi | B24B 39/003 | 29/90.01 |
| 6,356,002 | B1 * | 3/2002 | Witherspoon | H01R 43/10 | 310/232 |
| 2013/0218514 | A1 * | 8/2013 | Schieke | H01R 39/58 | 702/138 |
| 2014/0038434 | A1 * | 2/2014 | Winkler | H01R 39/24 | 439/29 |
| 2014/0055153 | A1 * | 2/2014 | Sato | G01R 31/34 | 324/750.3 |

FOREIGN PATENT DOCUMENTS

| | | | | |
|---|---|---|---|---|
| DE | 102012218095 | A1 * | 4/2014 | H01R 39/04 |
| EP | 2704267 | A2 | 5/2014 | |
| FR | 2691848 | A1 * | 12/1993 | H01R 39/34 |
| WO | WO-2010015359 | A1 * | 2/2010 | H02K 16/00 |
| WO | 2014094832 | A1 | 6/2014 | |

* cited by examiner

SLIPRING WITH WEAR MONITORING

CROSS-REFERENCE TO RELATED APPLICATIONS

This application is a continuation of pending International Application No. PCT/EP2015/073764 filed on Oct. 14, 2015, which designates the United States and claims priority from the European Application No. 14188832.1, filed on Oct. 14, 2014. The disclosure of each of the above-identified patent documents is incorporated herein by reference.

BACKGROUND

Field of the Invention

The invention relates to slip-rings for transmission of electrical signals between rotating parts. Specifically, it relates to wear monitoring in context of transmission of electrical signals between the rotating parts and a slip-ring device with improved wear monitoring.

Description of Relevant Art

Electrical slipring devices are used to transfer electrical power and/or signals between a rotating part and a stationary part of a given system. Such devices are used in different applications, such as wind energy plants or computer tomography scanners, for example. There are also several military and aerospace applications, in which sliprings find their use.

It is common to all of these applications, that a long lifetime and a low contact resistance as well as a low contact noise are required from the slipring. Furthermore, in specific applications such as those involving a CT scanner, comparatively high speeds caused by a rotation of up to four revolutions per second in a circumference of about 5 meters require specific attention. The same applies for specific environmental requirements that appear in, for example, aerospace applications.

Sliprings are generally constructed around a first part having sliding tracks and a second part having brushes for sliding on or gliding along the sliding tracks. Due to the mechanical friction there appears mechanical wear, which causes the slipring to degrade over time.

U.S. Pat. No. 4,831,302 A discloses a wear indicator that determines the length of a carbon brush and therefore indicates the wear of the brush. In most sliprings the sliding tracks have significantly longer lifetimes than the brushes, but these sliding tracks are also susceptible to wear. Currently, there is no means providing an indication of the wear of sliding tracks.

SUMMARY

The embodiments of the present invention are directed to providing a slipring having a reliable wear indicator, which is able to indicate wear of a slip-ring brush and/or of a sliding track.

In a first embodiment a slipring module or a slipring assembly is provided that comprises a plurality of sliding tracks, at least one of which is configured as a wear indication (or wear indicator) track. The at least one wear indicator track preferably is a sliding track that is not used for any other signal transmission and is used for wear indication only. A sliding brush, operably corresponding to the wear indication sliding track, is a wear indication sliding brush. Together, the wear indication sliding track and wear indication sliding track form a wear indication track-brush pair. Preferably, there is a wear indication (evaluation circuit that evaluates the status and/or quality and/or functionality of the wear indicator track. The circuit may be configured to measure at least one of a voltage drop, a noise, a bit error rate, a temperature, a contact resistance and contact interrupts caused by a worn sliding track to generate a warning signal. In a very simple embodiment, there would be a detection of wear if the transmission is interrupted due to wear. Preferably, there are two wear indicator tracks, and the wear indicator sliding tracks or the brushes are electrically connected together to form a loop for a test current of the evaluation circuit. Most preferably, at least one of the wear indication tracks is exclusively connected to the wear indication circuit.

Alternatively, the wear indication track may be used for transmission of a signal that is of low importance for the system into which the slipring assembly is integrated, but which can easily be detected such that a failure of the wear indication track can be recognized by identifying a failure of such low-importance signal. Preferably, any component of the wear indication track-brush pair has shorter lifetime, as compared to that of the remaining sliding tracks and sliding brushes of the slipring. Most preferably, a sliding track and/or a corresponding sliding brush from a wear indication track-brush pair is made pre-worn, in that has a degree of mechanical wear that is higher than a degree of wear of any remaining sliding tracks and/or sliding brushes.

Therefore, it is preferred for a component of the wear indication track-brush pair to have a shorter lifetime than that of the remaining tracks and/or sliding brushes. The wear indication track-brush pair may have passed a pre-wear procedure (which may be a run-in procedure, and preferably a run-in procedure under conditions that accelerate wear of a given sliding track and/or sliding brush, such as high temperature, high speed, or similar conditions).

In a related embodiment, the wear indicator track-brush pair is pre-used or pre-worn or is at least made such that it shows the signs of wear earlier than the other tracks. Therefore the design lifetime of the wear indicator track-brush pair is shorter than the design lifetime of any other track-brush pair.

In an alternative embodiment, a component of the wear indication track-brush pair may be manufactured by a process causing a shorter lifetime of such component compared to any of the remaining tracks and/or brushes. Such a process may, for example, be a galvanic plating with a thinner layer than that of a plating layer of a component of any other track-brush pair, such that the galvanic plating is worn earlier than the thicker platings of the remaining tracks.

In another embodiment, there is a higher stress level imposed on the wear indicator track-brush pair, which causes a component of the wear indicator track-brush pair to show the signs of wear earlier than any other track and/or brush. This may, for example, be done by applying a higher brush pressure while pressing the brush against a given sliding track. This may be done by using a stronger spring for a carbon brush or by using a stiffer wire for the wire brush. It may also be done by applying less grease or oil to the track. In a further embodiment, it may be done by applying a higher current or at least a higher current density to the brush, which may, for example, be accomplished by using a thinner brush wire.

In another embodiment, there may be provided an additional gear configured to rotate the wear indicator track at a higher speed than the other tracks.

In yet a further embodiment, there may be a sliding brush, preferably a wire brush, which wears quicker than other brushes. This may in addition provide a reliable brush wear indication.

Another embodiment provides a plurality of wear indicator tracks and/or brushes that may be designed differently from one another.

In a further embodiment, there may be present a shield configured to protect the other signal tracks from wear of the wear indicator track.

In a further embodiment, a sensor may be provided. The sensor may be a temperature sensor, which for example may detect over-temperature or which even may detect the temperature profile of the slipring and calculate lifetime expectancy independent of temperature. For example, extremely high or low temperature may shorten a lifetime, whereas the use of the slipring at moderate temperature levels may lengthen the lifetime. There may be an optical sensor that, for example, may be configured to detect electrical arcs at the slipring. There may be a shock and/or vibration sensor for detecting mechanical vibrations, which may be an indication of a worn slip-ring module. It may also detect external vibration, which further would reduce the lifetime of the slip-ring assembly.

BRIEF DESCRIPTION OF THE DRAWINGS

In the following, the idea and implementations of the invention will be described by way of example, without limitation of the general inventive concept, and with reference to the drawings.

Figure 1:
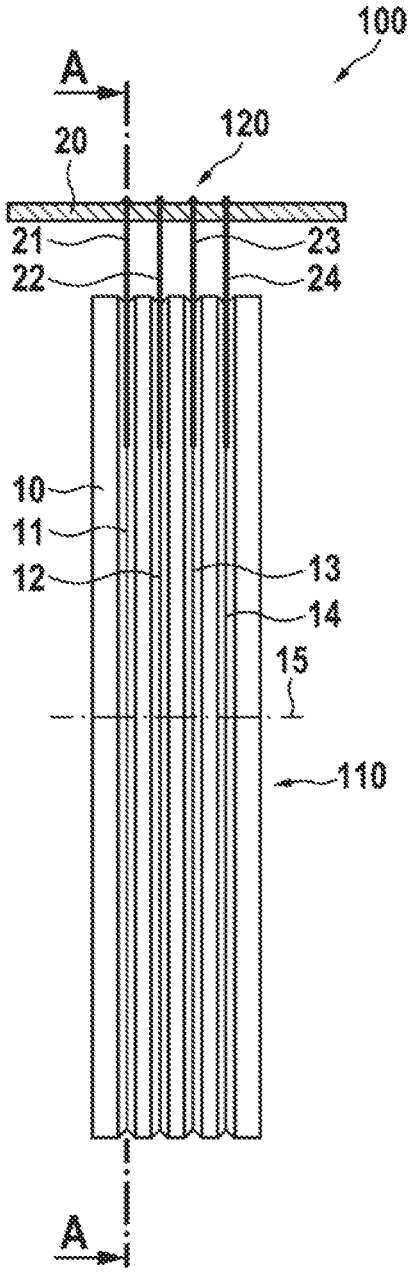
FIG. 1 shows a side view of a first embodiment.

While the implementations of the invention are susceptible to various modifications and alternative forms, specific embodiments are illustrated in the drawings and are described in detail. It should be understood, however, that the drawings and detailed description thereto are not intended to limit the invention to the particular disclosed form, but to the contrary, the intention is to cover all modifications, equivalents and alternatives falling within the spirit and scope of the present invention as defined by the appended claims.

DETAILED DESCRIPTION

In FIG. 1, a side view of a preferred embodiment is shown. A slipring assembly 100 comprises a slipring module 110 and a slipring brush block 120. The slipring module 110 may rotate about the rotation axis 15 and comprises an isolating body 10 having a plurality of sliding tracks. Here, four sliding tracks 11, 12, 13, and 14 are shown, although there may be any other number of sliding tracks present. The sliding tracks are embedded in and/or held by the isolating body 10. Preferably, the sliding tracks are isolated from each other. There may also be configurations, where at least some of the sliding tracks are connected together electrically. Such configurations may be useful for transferring higher currents or signals with lower levels of noise. Here, a preferred embodiment of sliding tracks having V-shaped grooves is shown. These V-grooves provide the advantage that they can guide wires sliding on them and keep the wires precisely on predetermined tracks. Any other type of sliding track may be used instead, such as, for example, a track having multiple grooves or a track without grooves and having a planar surface.

The slipring brush block comprises a brush carrier 20, which may be a printed circuit board or any other isolating material. It may also comprise a conducting material such as a metal, with isolated portions for holding the brushes. The brush block 20 holds a plurality of sliding brushes. In this embodiment, four wire brushes are shown, but there may be present any other number of brushes and any other kind of brushes. For example, the multi-fiber brushes or carbon brushes can be used. The brushes are spaced such that they fit to corresponding sliding tracks of the slipring module. There must not necessarily be one brush per sliding track, but there may also be a plurality of brushes contacting a given sliding track to increase current capability and/or reduce noise and/or contact resistance.

In this embodiment, there are a first sliding brush 21. (having a first section 21*a* and a second section 21*b*, as shown in a side view of FIG. 2) that contacts first sliding track 11; a second sliding brush 22 that contacts a second sliding track 12, a third sliding brush 23 that contacts a third sliding track 13, and a fourth sliding brush 24 that contacts fourth sliding track 14. Sliding brushes 22, 23, 24 are structured by analogy with the brush 21.

Preferably, the first sliding track 11 together with the first sliding brush 21 are used for wear indication. They may be used together with the second sliding track 12 and the second sliding brush 22, as will be shown later. Of course any other sliding tracks together with their corresponding sliding brushes may be used for wear indication.

Figure 2:
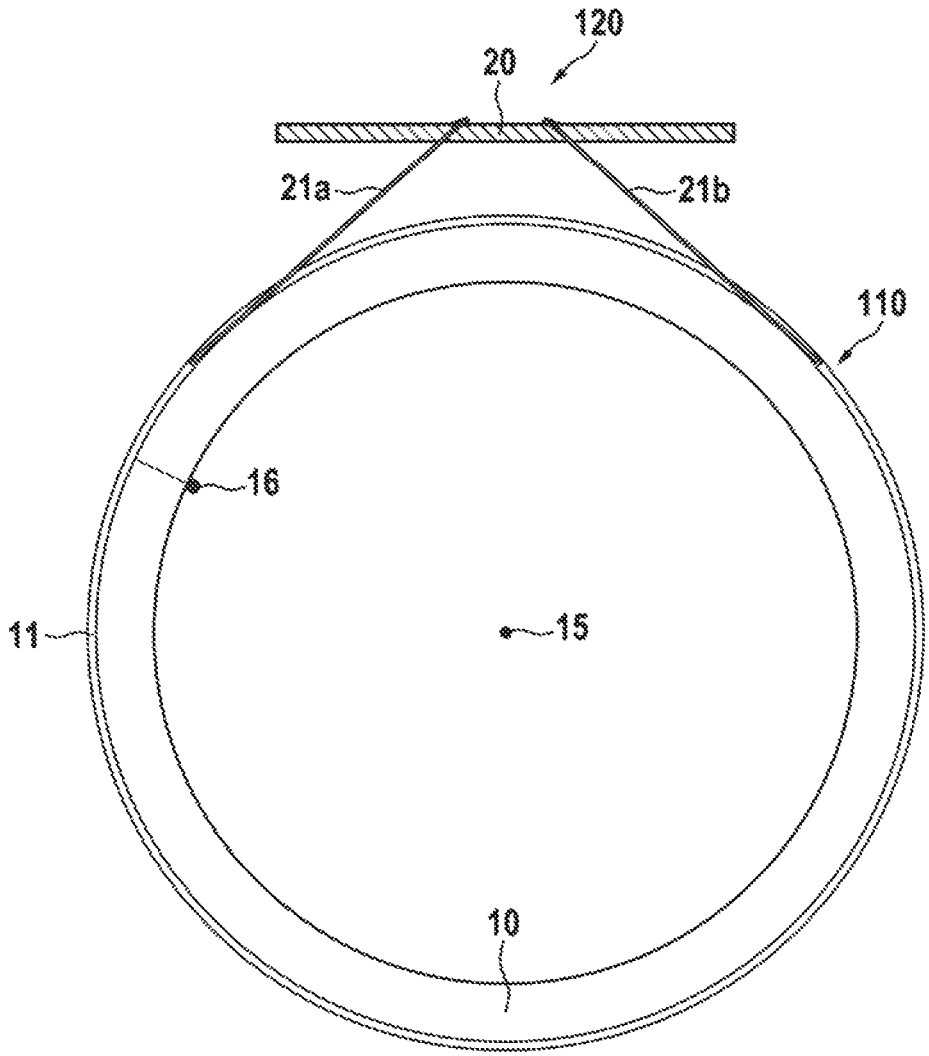
FIG. 2 shows a sectional view of the first embodiment.

In FIG. 2, a sectional view of the first embodiment is shown in a plane cut through lines A-A of FIG. 1. It is preferred that the slipring module have a free bore, for example for carrying cables. A connector 16 is shown, which may be a soldering point or soldering pin or a connector, which contacts the first sliding track 11. A connecting cable may be soldered to this connector. Preferably, the other sliding tracks also have connectors to contact the sliding tracks from the inner side of the isolating body.

Figure 3:
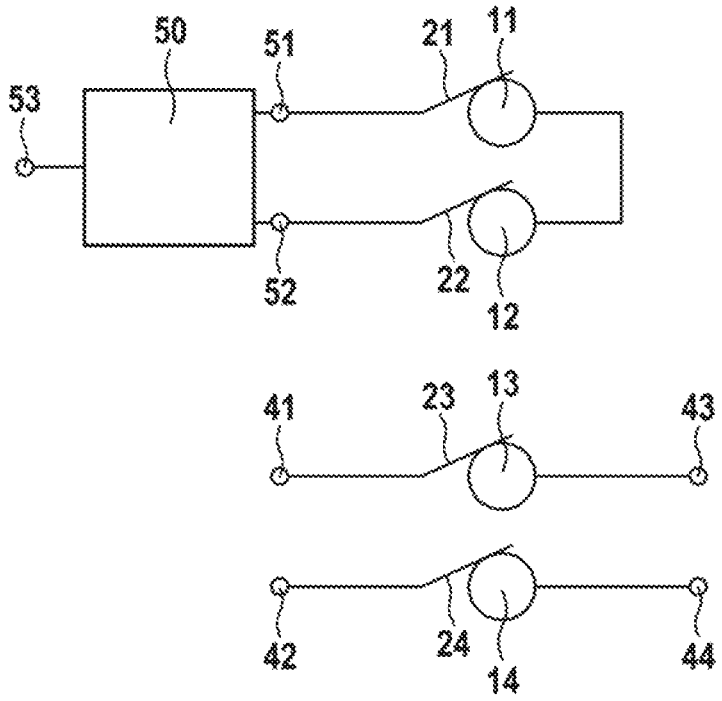
FIG. 3 shows a circuit diagram of a first embodiment.

In FIG. 3, a circuit diagram of a first embodiment is shown. The slipring assembly comprises a main signal path through the third sliding brush 23 together with the third sliding track 13, and the fourth sliding brush 24 together with the fourth sliding track 14, which is accessible through the first brush connection 41, the second brush connection 42, and the first ring connection 43 and the second ring connection 44. The assembly further includes a wear indication circuit 50 that has a first test port 51 and a second test port 52 connected to the first sliding brush 21 and the second sliding brush 22, which are in contact with the first sliding track 11 and the second sliding track 12. Both sliding tracks are connected to each other, thereby allowing a current flow between the first test port 51 and the second test port 52. The test results are output via the signal port 53. The third sliding brush 23 together with the third sliding track 13, and the fourth sliding brush 24 together with the fourth sliding track 14 are used for normal signal and/or power transmission over the slipring assembly. As the normal signal paths and the sliding tracks and brushes used for wear detection are completely separated, the overall design is comparatively simple. No care must be taken about electrical connections, unwanted currents and noise.

Figure 4:
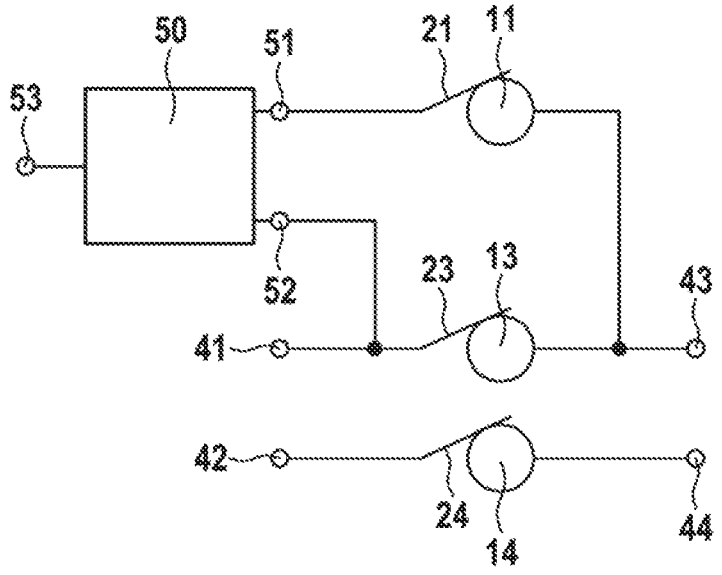
FIG. 4 shows a simplified circuit diagram.

In FIG. 4, a simplified circuit diagram is shown. In this embodiment, only three sliding tracks together with brushes are used. Here, the second test port 52 of the wear indication circuit 50 is connected to the first signal path comprising third sliding brush 23 and the third sliding track 13. Here, at least a common sliding track and a sliding brush are shared with the main signal path. This configuration reduces the number of required tracks. In this example sliding brush 22 and sliding ring 12 are no more required.

Figure 5:
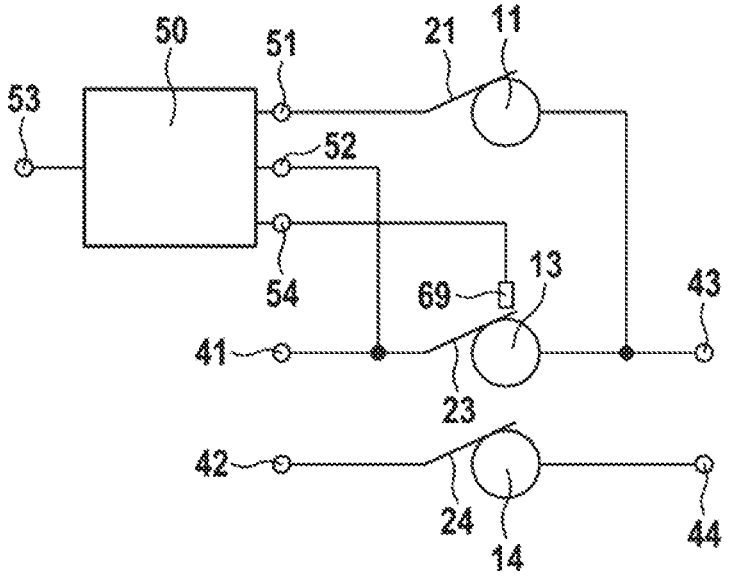
FIG. 5 shows a further embodiment using a sensor.

In FIG. 5, a further embodiment having a sensor is shown, using a sensor 69 which may be connected by a sensor port 54 to the wear indication circuit 50. Here, only one connecting line is shown, which may comprise a plurality of electrical wires, as may be required by the sensor. The sensor may be a temperature sensor, which for example may be configured to detect over-temperature or even the temperature profile of the slipring and may allow the wear indication circuit to calculate lifetime expectancy independent from temperature. For example, extremely high or low temperature may shorten the lifetime, whereas using the slipring at moderate temperature levels may lengthen it. There may be an optical sensor that, for example, may be configured to detect electric arcs at the slipring. There may be a shock and/or vibration sensor for detecting mechanical vibrations, which may be an indication of a worn slipring module. It may also detect external vibration, which further would reduce the lifetime of the slipring assembly.

Figure 6:
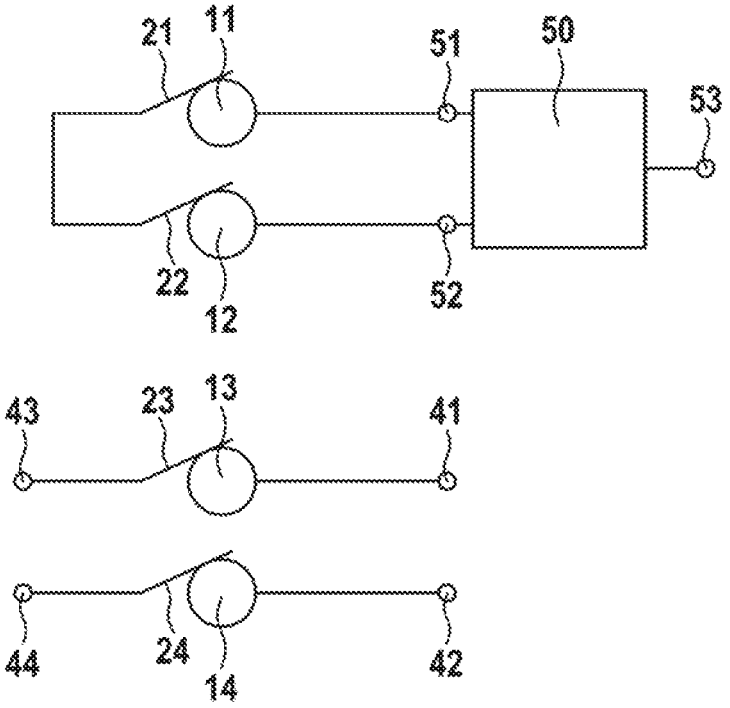
FIG. 6 shows a modified embodiment.

In FIG. 6, a modified embodiment is illustrated. Here, the wear indication circuit 50 is connected to the sliding tracks 11 and 12, whereas the short circuit is at the brushes 21 and 22 that are connected together. A similar modification may be applied to any embodiments, because a slipring may be operated in any direction.

Figure 7:
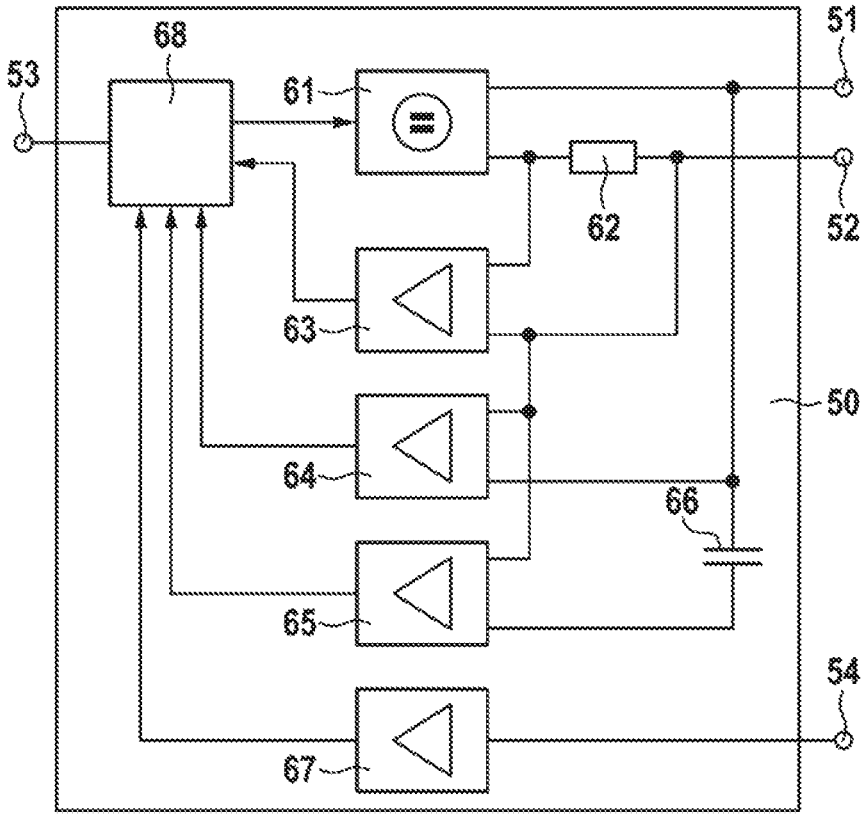
FIG. 7 shows a simplified block diagram of the wear indication circuit.

In FIG. 7, a simplified block diagram of the wear indication circuit 50 is shown. A test signal source 61, which preferably is a DC current or voltage source (which also may be an AC current or voltage source), is connected via the first test port 51 and the second test port 52 to at least one sliding track and/or at least one sliding brush as shown above. The test signal source 61 may be controlled by an evaluation circuit 68. This evaluation circuit 68 may set up a specific current or voltage profile. For example, during short periods, a comparatively high current may be delivered to the slipring for measuring the high-current performance. A series resistor 62 may be provided for measuring the current flowing through the sliding brush and sliding track, although current measurement may be done by other means like a hall sensor detecting the magnetic field of the current or a current transformer for measuring an AC current. The voltage at the series resistor 62 may be amplified by current measurement amplifier 63 and delivered to evaluation circuit 68. A voltage measurement amplifier 64 may be provided for measuring the voltage between the at least one sliding brush and the sliding track connected to the first test port 51 and second test port 52. Under normal operating conditions, the resistance of the slipring connection between the sliding brushes and sliding tracks may be comparatively low, so the voltage drop should be comparatively low. With increasing wear of the slip-ring, the voltage drop will increase. There may further be an AC voltage measurement amplifier 65, which may be coupled via a capacitor 66 for measurement of AC or RF signals. Such signals may arise from contact noise, which may also increase with wear. Furthermore, a sensor amplifier 67 may be provided for delivering a signal in relation to the output of a sensor 69, connected to sensor port 54, to the evaluation circuit 68. There may be a signal port 53 connected to the evaluation circuit 68, by which the evaluation circuit 68 may signal an abnormal condition, a slip-ring OK signal, or even a complex numerical output, like the estimated total lifetime, the remaining lifetime, the total number of revolutions, or the estimated number of remaining revolutions. It is preferred if the evaluation circuit is a microcontroller, and it is further preferred if the signal port 53 is a port of a bus system. Such a bus system may be a CAN bus or any other industrial control bus, or Ethernet or any wireless communication interface.

It will be appreciated by those skilled in the art that this invention provides sliprings for transfer of electrical signals and power. Modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 isolating body
11 first sliding track
12 second sliding track
13 third sliding track
14 fourth sliding track
15 rotation axis
16 connector
20 brush carrier
21, 21*a*, 21*b* first sliding brush
22 second sliding brush
23 third sliding brush
24 fourth sliding brush
41 first brush connection
42 second brush connection
43 first ring connection
44 second ring connection
50 wear indication circuit
51 first test port
52 second test port
53 signal port
54 sensor port
61 test signal source
62 series resistor
63 current measurement amplifier
64 voltage measurement amplifier
65 AC voltage measurement amplifier
66 capacitor
67 sensor amplifier
68 evaluation circuit
69 sensor
100 slip-ring assembly
110 slip-ring module
120 slip-ring brush block

The invention claimed is:

1. A slipring assembly comprising:

a slipring module, a slipring brush block, and a wear-indication circuit, the slipring module further comprising a plurality of sliding tracks, the slipring brush block further comprising a plurality of sliding brushes configured to slide on sliding tracks from the plurality of sliding tracks, wherein at least one combination of a sliding track with a respectively-corresponding sliding brush is a wear-indication track-brush pair that is electrically connected to the wear-indication circuit, wherein the sliding track of said wear-indication track-brush pair has a shorter lifetime than that of any remaining track from said plurality of sliding tracks, wherein the sliding brush of said wear-indication track-brush pair contains a structural feature that, in operation of the slipring assembly, causes a lifetime of said sliding brush to be shorter than that of any other sliding brush of the slipring assembly.

2. A slipring assembly according to claim 1, wherein the sliding track of said wear-indication track-brush pair contains a structural feature that, in operation of the slipring assembly, causes a lifetime of said sliding track to be shorter than that of any other sliding track of the slipring assembly.

3. A slipring assembly according to claim 1, wherein the sliding track of said wear-indication track-brush pair is mechanically pre-worn as compared with any remaining sliding track of the slipring assembly.

4. A slipring assembly according to claim 1, wherein the sliding track of said wear-indication track-brush pair includes at least one of (a) a first galvanic coating that is thinner than a second galvanic coating carried by any remaining sliding track of the slipring assembly, and (b) the first galvanic coating made of a material different from a material of the second galvanic coating.

5. A slipring assembly according to claim 1, wherein the sliding track of said wear-indication track-brush pair is configured to be under higher mechanical stress than any remaining sliding track of the slipring assembly.

6. A slipring assembly according to claim 1, wherein the sliding track of said wear-indication track-brush pair is subjected to a higher current or a higher current density than that of any remaining sliding track of the slipring assembly.

7. A slipring assembly according to claim 1, configured to rotate the sliding track of said wear-indication track-brush pair at a first speed higher than a second speed at which any remaining sliding track of the assembly is rotated by the slipring assembly.

8. A slipring assembly according to claim 1, wherein the sliding track of said wear-indication track-brush pair is configured to operate only as a wear-indicator track and not to transmit any other signal in operation of the slipring assembly.

9. A slipring assembly according to claim 1, wherein at least one of the following conditions is satisfied:

(i) a contact between the sliding brush and the sliding track of the wear-indication track-brush pair is characterized by a contact pressure that is higher than that of a contact between any other sliding brush and a corresponding sliding track; and (ii) the sliding track of the wear indication track-brush pair contains less lubricant than an amount of lubricant present on any other sliding track.

* * * * *